US008379489B1

(12) United States Patent
Jones

(10) Patent No.: US 8,379,489 B1
(45) Date of Patent: Feb. 19, 2013

(54) DEVICES FOR QUANTIFYING THE PASSAGE OF TIME

(75) Inventor: John David Jones, Pittsburgh, PA (US)

(73) Assignee: DS Zodiac, Inc., Seattle, WA (US)

( * ) Notice: Subject to any disclaimer, the term of this patent is extended or adjusted under 35 U.S.C. 154(b) by 0 days.

(21) Appl. No.: 13/484,198

(22) Filed: May 30, 2012

Related U.S. Application Data

(63) Continuation of application No. 13/300,459, filed on Nov. 18, 2011.

(51) Int. Cl.

| | |
|---|---|
| ***G04B 19/24*** | (2006.01) |
| ***G04B 19/04*** | (2006.01) |
| ***G04C 17/00*** | (2006.01) |
| ***G04C 19/00*** | (2006.01) |

(52) U.S. Cl. ..... 368/28; 368/29; 368/80; 368/82; 368/223

(58) Field of Classification Search ..... 368/10, 368/28, 29, 80, 82, 107–109, 155, 156, 223, 368/228

See application file for complete search history.

(56) References Cited

U.S. PATENT DOCUMENTS

| | | | | | |
|---|---|---|---|---|---|
| 3,628,322 | A | * | 12/1971 | McDuffee et al. | 368/28 |
| 3,750,384 | A | * | 8/1973 | Miller et al. | 368/82 |
| 3,943,288 | A | * | 3/1976 | Reed et al. | 379/110.01 |
| 3,976,867 | A | * | 8/1976 | Campbell | 708/111 |
| 4,005,571 | A | * | 2/1977 | Wolff | 368/108 |
| 4,175,378 | A | * | 11/1979 | Shelton | 346/20 |
| 4,280,209 | A | * | 7/1981 | Mooney | 368/71 |
| 4,541,726 | A | * | 9/1985 | Rachofsky | 368/80 |
| 4,618,265 | A | * | 10/1986 | Wadowski | 368/82 |
| 4,872,150 | A | * | 10/1989 | Norman | 368/223 |
| 4,926,400 | A | * | 5/1990 | Rachofsky et al. | 368/82 |
| 4,928,270 | A | * | 5/1990 | Chovin et al. | 368/82 |
| 4,974,242 | A | * | 11/1990 | Vuilleumier | 368/37 |
| 5,058,085 | A | * | 10/1991 | Lawler | 368/28 |
| 5,432,759 | A | * | 7/1995 | Vaucher | 368/28 |
| 5,999,492 | A | * | 12/1999 | Teixeira | 368/10 |
| 6,069,848 | A | * | 5/2000 | McDonald et al. | 368/107 |
| 6,579,004 | B1 | * | 6/2003 | Kim | 368/295 |
| 6,809,993 | B1 | * | 10/2004 | Muller et al. | 368/242 |
| 2002/0118606 | A1 | * | 8/2002 | Albisetti et al. | 368/80 |
| 2011/0130139 | A1 | * | 6/2011 | Ali et al. | 455/435.1 |

OTHER PUBLICATIONS http://www.shodor.org/interactive/activities/NumberBaseClocks/; "Learner", Feb. 14, 2010.*
http://www.shodor.org/interactive/activities/NumberBaseClocks/; "Activity", Feb. 14, 2010.*
http://www.shodor.org/interactive/activities/ClockArithmetic/; "Activity", Jan. 10, 2011.*
http://zapatopi.net/zapatoware/clocks.html; May 14, 2011.*
http://www.intuitor.com/hex/hexclock.html; May 15, 2011.*
Archive.orgIntuitor; May 15, 2011.*
Archive.orgZatopi; May 14, 2011.*
ArchiveShodorl; Feb. 14, 2011.*
Archive.orgShodor2; Jan. 10, 2011.*
Archive.orgShodor3; May 15, 2011.*

(Continued)

*Primary Examiner* — Vit W Miska
(74) *Attorney, Agent, or Firm* — Christensen O'Connor Johnson Kindness PLLC

(57) ABSTRACT

Devices, systems, and methods for presenting date and time information are described. In some embodiments, a date and/or a time value is presented as a base-36 number. In some embodiments, an integral portion of the base-36 number represents a date value, and a fractional portion of the base-36 number represents a time value. Each base-36 digit may be represented by one of the numerals 0-9 and the letters A-Z. Both digital and analog clocks displaying date and/or time information in which a day is broken into thirty-six increments are disclosed.

17 Claims, 6 Drawing Sheets

OTHER PUBLICATIONS

Dwyer, D., "How Quartz Watches Work," Apr. 1, 2000, HowStuffWorks.com, <http://electronics.howstuffworks.com/gadgets/clocks-watches/quartz-watch.htm> [retrieved May 16, 2012, 2 pages.

"Metric Time," Wikipedia®, <http://en.wikipedia.org/wiki/Metric_Time> [retrieved May 16, 2012], 5 pages.

"Decimal Time," Wikipedia®, <http://en.wikipedia.org/wiki/Decimal_Time> [retrieved May 16, 2012], 8 pages.

* cited by examiner

DEVICES FOR QUANTIFYING THE PASSAGE OF TIME

CROSS-REFERENCE TO RELATED APPLICATION

This application is a continuation of application Ser. No. 13/300,459, filed Nov. 18, 2011, the entire disclosure of which is hereby incorporated by reference herein.

BACKGROUND

Currently, the most popular formats for conveying date and time information are incredibly archaic. Telling time in the standard hours-minutes-seconds format can be terribly confusing, especially considering that hours are calculated in a different scale than minutes and seconds, and both are calculated in a different scale than months or years. Further, a time expressed in hours-minutes-seconds format only carries one type of meaning: a time of day. Expressing calendar information can be just as difficult. For example, the Gregorian calendar contains months of differing numbers of days, is altered during leap years, and is not easily converted to measure times from dates other than January 1 of a base year, such as the commonly used Year 1 of the Common Era (CE).

What is needed is a device that can display time and/or date information in a more useful format than the traditional clock and calendar formats.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, a device for displaying time information is provided. The device comprises a mechanism configured to generate an indication of passing time, a processor configured to interpret the generated indication of passing time received from the mechanism, at least one input device communicatively coupled to the processor, and a display communicatively coupled to the processor and configured to present an alphanumeric string representing a time. The processor is configured to cause the display to present an alphanumeric string representing the time in a first format or a second format, and to cause the display to switch between the first format and the second format in response to an interaction with the at least one input device. The first format includes a time of day in an hours-minutes format, and the second format includes a time that has passed since a beginning of a day in base-36 format.

In some embodiments, a clock is provided comprising a face having a plurality of markings for indicating passing time, a period indicator movable along the plurality of markings, a fraction indicator movable along the plurality of markings, and a mechanism coupled to the period indicator and the fraction indicator. The period indicator is configured to move the period indicator along the plurality of markings once per day, and to move the fraction indicator along the plurality of markings thirty-six times per day.

In some embodiments, a clock configured to display a time of day is provided. The time of day is displayed as a base-36 number representing a fractional period of a day that has passed since the previous day.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
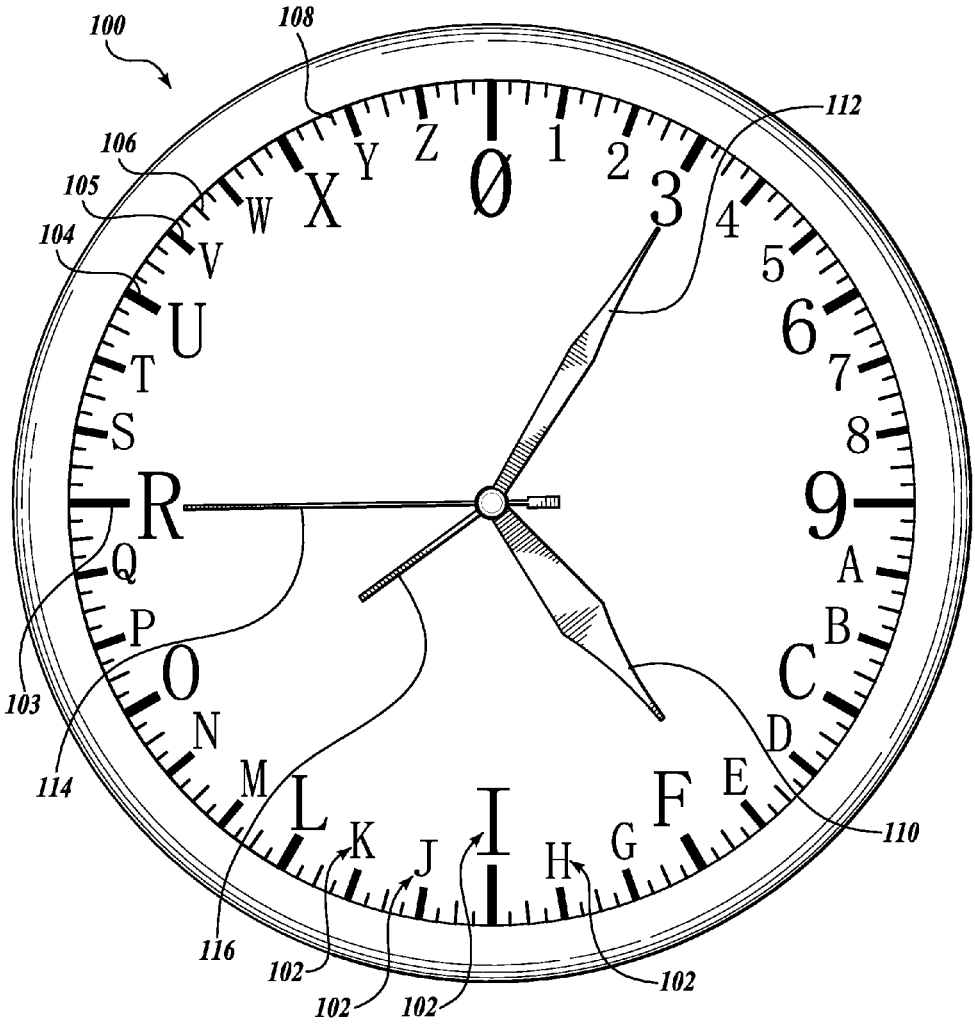
FIG. 1 illustrates an exemplary embodiment of a clock according to various aspects of the present disclosure.

The present application discloses the concept of CFILORUX time. In CFILORUX time, a day is divided into thirty-six increments, called "periods." Periods are likewise divided into thirty-six increments called "fractions," which are likewise divided into thirty-six increments, and so on. This subdivision may be continued into smaller and smaller increments in order to obtain a desired amount of precision in an expression of time.

Days are also grouped together into larger units of time. A group of thirty-six days is called a "cycle." Cycles may be grouped in units of thirty-six, and those groupings may be grouped in units of thirty-six, and so on in order to obtain a desired magnitude in an expression of time.

The measurement of time in increments of thirty-six has numerous attendant advantages. For example, the number thirty-six is divisible by at least two, three and four, making it easily split into halves, thirds, and quarters. As another example, measuring all increments in multiples of thirty-six (instead of in twelve or twenty-four increments for traditional hours, sixty increments for minutes and seconds, and varying increments for months and years) provides consistency and ease of computation. One need not remember the arbitrarily proportioned 60 traditional minutes in a traditional hour, 24 traditional hours (and therefore 1440 traditional minutes) in a day, 30 days (and therefore 720 traditional hours, or 43,200 traditional minutes) in some traditional months, and so on. Even worse is dividing the traditional units: 1 minute is $1/60$ of an hour, but $1/1440$ of a day, and so on. Instead, one can simply state that there are 36 fractions in a period, $36^2$ fractions in a day, and $36^3$ fractions in a cycle. Likewise, in base-36, 1 period is 0.1 of a day, 0.01 of a cycle, and so on (in base-36). This consistency may also be maintained to arbitrary levels of magnitude and precision, unlike traditional time and date systems.

As another example of the advantages of CFILORUX time, CFILORUX time and date values may be expressed separately or together as a base-36 number. Base-36 is particularly useful because each digit may be expressed by one of the characters 0-9 and A-Z. Hence, alphanumeric strings such as words have a meaningful value. A time of "FOOD" in hours-minutes format is meaningless, while a time of "FOOD" in CFILORUX format has a specific meaning, as discussed further below. The use of base-36 also allows CFILORUX date values to be compressed into small amounts of display space. For example, to unambiguously display a full date in the Gregorian calendar requires at least ten characters: two for the month of the year, two for the day of the month, and four digits for the year (e.g., "Mar. 15, 2011"). Meanwhile, the same date could be unambiguously represented in a CFILORUX date string of only four characters, such as "FQSX" (734,212 days from January 1, Year 1 to Mar. 15, 2011 on the Gregorian calendar, represented in base-36). In a string of five characters, a CFILORUX date value can display unambiguous date information up to at least the year 165551 when measured on the Gregorian calendar.

As another example, to correctly display a time in hours-minutes format, at least four characters are required: two characters for the hour (from "00" to "12" or "24") and two characters for the minute ("00" to "59"). To display a CFILORUX time with a similar precision, only two characters are required (from "0" to "Z" for the period, and from "0" to "Z" for the fraction). The use of characters 0-9 and A-Z is exemplary only, as any set of 36 characters may be used without departing from the scope of the present disclosure.

CFILORUX time is also easily adapted to differing time bases. In one exemplary embodiment, the CFILORUX "day" is based on a mean solar day of the Earth, with the period "I" in a particular location coinciding with solar noon (similar to how solar noon in a particular location coincides with 1200 hours on a traditional 24-hour clock). However, in other embodiments, the CFILORUX "day" may easily be based on other standards, such as a mean sidereal day of the Earth, or with some other period coinciding with a particular location of the Sun or a particular other star. In other embodiments, CFILORUX time may be applied to other celestial bodies, such as, for example, an embodiment with a CFILORUX day that coincides with a sidereal day or solar day of Mars or Jupiter.

In some embodiments, CFILORUX time and date values may be calibrated to coincide with other calendars. For example, if CFILORUX times and dates are calibrated to coincide with the Gregorian calendar, Jan. 1, 2011 on the Gregorian calendar would coincide with a CFILORUX date value of FQH2 (assuming that the Gregorian calendar extends back to January 1, Year 1 CE, and that there were therefore 734,150 days between January 1, Year 1 CE and Jan. 1, 2011 CE). However, the start date of CFILORUX time may be recalibrated to measure from any start date on another calendar. For example, an individual may wish to calibrate CFILORUX time from a date on another calendar that is important to them, such as a date of birth, an anniversary, a beginning of a training program, and/or any other date. This makes CFILORUX time incredibly simple to measure both durations of time from an arbitrary starting point and to indicate durations of time from a starting point agreed upon by others.

FIG. 1 illustrates an exemplary embodiment of a clock 100 according to various aspects of the present disclosure. The clock 100 includes a plurality of markings 103, 104, 105 that divide a face of the clock 100 into thirty-six increments. As illustrated, each of the thirty-six increments is indicated by either a primary marking 103, a secondary marking 104, or a tertiary marking 105. The primary markings 103 indicate quarters of a period, the secondary markings 104 divide those quarters further into thirds, and the tertiary markings 105 divide the thirds of the secondary markings further into thirds. The illustrated primary markings 103 are larger than the secondary markings 104, and the secondary markings 104 are larger than the tertiary markings 105 in order to provide cues for the eyes of a user reading the clock 100. Other markings may subdivide the face of the clock 100 even further, such as a half marking 106 and a quarter marking 108.

These markings are exemplary only, and any other types of markings may be used. For example, any of the primary markings 103, secondary markings 104, and tertiary markings 105 may be the same size as each other. As another example, any of the primary markings 103, secondary markings 104, and tertiary markings 105 may be omitted.

In the illustrated embodiment, the plurality of markings 103, 104, 105 are labeled with a plurality of labels 102. The labels provide a convenient way for a user to know how far from an origin marking a particular other marking is, with the "9" marking being nine markings away from the origin, the "I" marking being eighteen markings away from the origin ("I" markings in base-36), and so on. As illustrated, each marking 103, 104, 105 is labeled, and the size of the character used in the label reflects the size of the corresponding marking. In other embodiments, each of the labels may be the same size, or some or all of the labels may be omitted. Further, the illustrated font and character set are exemplary only, and any suitable font or character set may instead be used for the markings.

Not visible in FIG. 1 is a mechanism. Similar to a digital or analog mechanism in a traditional clock, the mechanism of the clock 100 causes one or more indicators to travel along the plurality of markings to indicate passing time. In the illustrated embodiment, the clock 100 includes a period indicator 110 and a fraction indicator 112. Each of the indicators is coupled to the mechanism such that the mechanism causes the indicators to travel along the plurality of markings. The mechanism causes the period indicator 110 to completely travel along the plurality of markings (e.g., make one complete revolution of the face of the clock 100) once a day. Hence, the period indicator 110 indicates the current period within the day, such that at "I" o'clock, the period indicator 110 will be pointing at the marking labeled with "I", and so on. The mechanism causes the fraction indicator 112 to completely travel along the plurality of markings once per period—in other words, thirty-six times a day—thus indicating a fraction of a period during the current period. Accordingly, if the period indicator 110 is pointing at the marking labeled with "C" (or between the marking labeled with "C" and the marking labeled with "D"), and the fraction indicator 112 is pointing at the marking labeled with "6," the clock 100 may be said to be indicating that the CFILORUX time is "C6" o'clock.

As illustrated, the clock 100 also includes a day indicator 114 and a cycle indicator 116. The mechanism causes the day indicator 114 to completely travel along the plurality of markings once per cycle—in other words, once every thirty-six days. The mechanism causes the cycle indicator 116 to completely travel along the plurality of markings once every thirty-six cycles. This allows the clock 100 to indicate the passage of days in CFILORUX format using the same type of scale and same indicator as with the CFILORUX time shown by the other indicators. This is preferable to traditional clocks that would display a date with a different type of indicator, or with a similar indicator at a different scale, at least because it simplifies the markings used.

To interpret the time shown on the illustrated clock 100, one would note that the cycle indicator 116 is pointing between the marking labeled "N" and the marking labeled "0," the day indicator 114 is pointing at the marking labeled "R," the period indicator 110 is pointing between the marking labeled "E" and the marking labeled "F," and the fraction indicator 112 is pointing at the marking labeled "3." This would indicate a CFILORUX date and time of "NR.E3". This date is 855 days after the calibrated start date, and indicates a time of approximately 9:23 AM.

As stated above, the clock 100 embodiment illustrated in FIG. 1 is exemplary only. Other embodiments of clocks displaying CFILORUX time may use marking formats other than circular (such as linear, cylindrical, and/or the like), and may have indicators which may be of different shapes or move along different paths (such as along the circumference of the clock 100 instead of rotating about the center, directly along the path of marking, and/or the like). Other embodiments of clocks may also include more or fewer indicators to show time periods of greater magnitude or precision.

Figure 2:
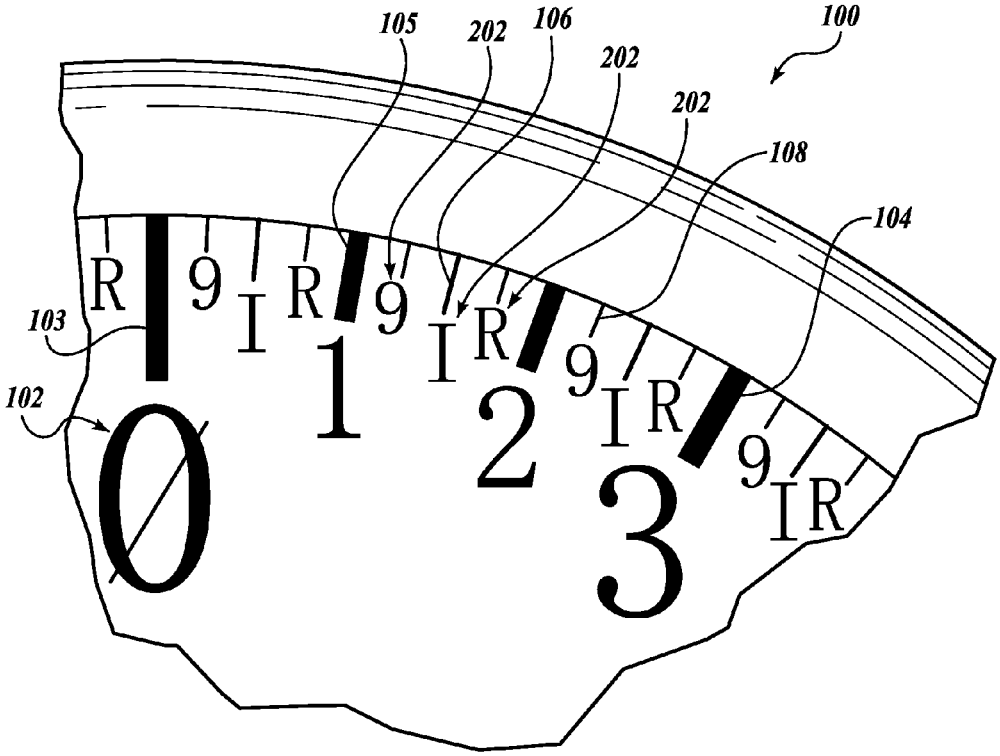
FIG. 2 illustrates further details of an exemplary embodiment of a clock including half markings and quarter markings.

FIG. 2 illustrates further details of an exemplary embodiment of a clock 100 including half markings 106 and quarter markings 108. The half markings 106 and quarter markings 108 may be useful in embodiments wherein fine precision is desired with respect to reading the position of an indicator that falls between primary markings 103, secondary markings 104, and tertiary markings 105. As each of the spaces between markings may be further subdivided into thirty-six portions, the half markings 106 and quarter markings 108 divide the portion in halves and quarters, respectively. Each of these markings may include a label that indicates a number of the half marking 106 or quarter marking 108, similar to the label 102 on the primary marking 103 of the clock 100, making it easier to interpret the position of the indicators at a glance.

Figure 3:
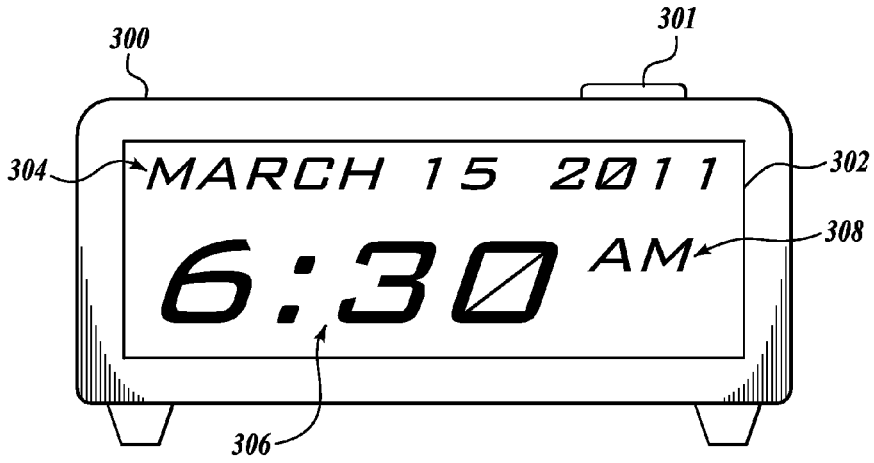
FIGS. 3-5 illustrate an exemplary embodiment of a clock having a changeable digital display according to various aspects of the present disclosure.
Figure 4:
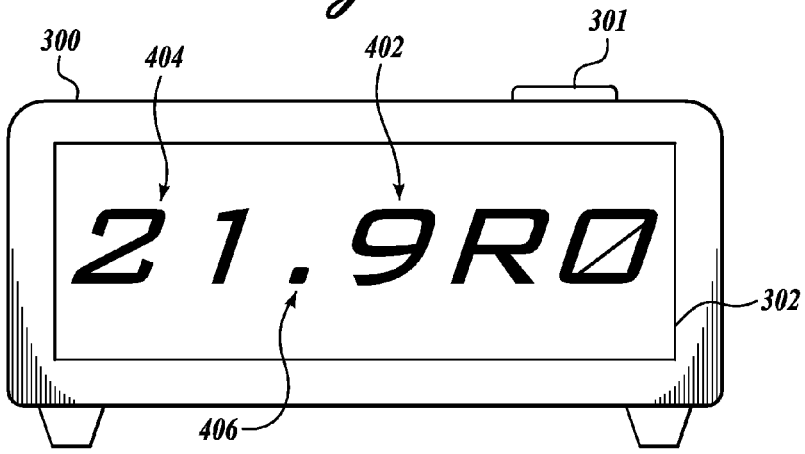
Figure 5:
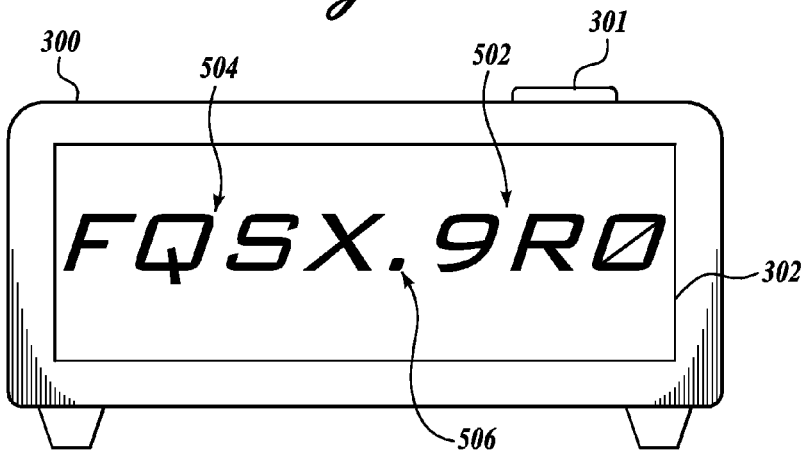

To accelerate acceptance of CFILORUX time, it may be beneficial to provide clocks that will translate between traditional date/time formats and CFILORUX time. FIGS. 3-5 illustrate an exemplary embodiment of a clock 300 having a changeable digital display according to various aspects of the present disclosure. The clock 300 includes a display 302 and an input device 301. The clock 300 also includes at least one processor (not illustrated) that is communicatively coupled to both the input device 301 and the display 302. Further, the clock 300 includes a mechanism (not illustrated) configured to generate an indication of passing time, such as a crystal oscillator, a mechanical spring, and/or any other suitable mechanism, and to provide that indication to the processor. The at least one processor is configured to cause the display 302 to present a date and a time, and to update the date and the time based on the indication of passing time received from the mechanism.

As illustrated, the clock 300 is similar to a traditional alarm clock, and the input device 301 is a simple mechanical switch such as a button and/or the like. In other embodiments, the input device 301 may be any other suitable input device such as a keypad, keyboard, touch pad, touch screen, mouse, and/or the like. Further, the display 302 may be a simple multi-segment LCD display, but in other embodiments, the display 302 may be a high resolution display, a video screen, and/or the like. The display 302 and the input device 301 may be combined into a single touchscreen input and display device, such as in an embodiment wherein the clock 300 is a smart phone running a clock application; a desktop computer, laptop computer, or tablet computer running a clock application; and/or any other suitable computing device.

In FIG. 3, the clock 300 is displaying a traditional date/time format. The date 304 is displayed in a commonly accepted Gregorian calendar format. However, this embodiment is exemplary only, and other common solar, lunar, or lunisolar calendar formats, such as the Islamic calendar, the Jewish calendar, the Chinese calendar, and/or the like; or calendars based on other dates such as regional years or calendars and/or the like, may be used. The time 306 is presented in a 12-hour hour-minute format with an AM/PM indicator 308 showing that this time is in the morning.

FIG. 4 illustrates the clock 300 after an interaction with the input device 301, such as a press of a button used to switch between display formats. The number of days since a specified start date is expressed as an integral portion 404 of a base-36 number in an alphanumeric string representing the CFILORUX time. The time of day is expressed as a fractional portion 402 of the base-36 number. The alphanumeric string includes a radix point 406 to separate the integral portion 404 from the fractional portion 402. FIG. 4 shows at least one advantage of using CFILORUX time, in that the specified start date has been set to Jan. 1, 2011, to track the progress through the traditional Gregorian calendar year. Another advantage shown in FIG. 4 is that the date and time can be expressed in a single alphanumeric string, which provides a much less cluttered and easier to read display than that of the traditional display shown in FIG. 3.

FIG. 5 illustrates the clock 300 showing the same date/time as illustrated in FIGS. 3 and 4, but with a specified start date set to January 1, year 1 CE of the Gregorian calendar (as discussed above). The integral portion 504 of the base-36 number in an alphanumeric string indicates the number of days, cycles, etc. that have passed since the specified date, and the fractional portion 502 indicates the time of day, with the radix point 506 separating the two.

In some embodiments, the clock 300 may provide a mode that allows the user to reconfigure the specified start date for CFILORUX time. In some embodiments, the clock 300 may provide a mode that allows the user to calculate conversions between CFILORUX times and traditional times without changing a time to which the clock 300 is set. This may also be helpful for promoting the acceptance of CFILORUX time. For example, the expression of time using alphanumeric strings will make CFILORUX very popular for expressing times that spell out words. However, it may be difficult to communicate those times to others who are not fully exposed to CFILORUX time without having a device such as the clock 300 to convert between the two. In the conversion calculation mode, the clock 300 may accept input of a clever text string such as ".SEX" and convert it into an hour-minute-second time, or approximately "6:56 PM". This can be even better than times currently used as slang that do not carry inherent meaning. For example, the time "4:20 PM" does not carry any recognizable meaning, but the CFILORUX time ".POT", translated to approximately "5:07 PM," may be more easily understood. Other times, such as ".FOOD" (approximately 10:27 AM) or ".COFFEE" (approximately 8:27 AM) also serve as good examples of times that may be converted to or from common words.

One of ordinary skill in the art will understand that, when measured in traditional hour-minute-second time, the times ".POT," ".FOOD," and ".COFFEE" are considerably more precise due to the additional significant digits. While a three-digit time such as "5:07 PM" is accurate to within one minute, or approximately $1/1440$th of a day, a three-digit CFILORUX time such as ".POT" is accurate to within approximately $1/46{,}656$th of a day, or about 1.85 seconds. Hence, CFILORUX times are generally of much higher precision than traditional times, though some will coincide with traditional times using similar numbers of significant digits (e.g., "0.000" corresponds to midnight, ".C90" corresponds to 8:10 AM, ".I00" corresponds to noon, and so on).

Figure 6:
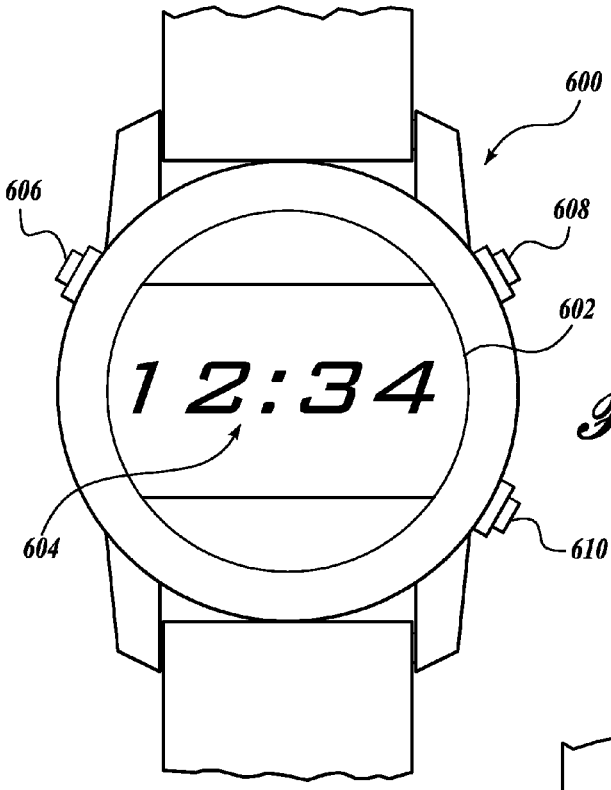
FIGS. 6 and 7 illustrate another exemplary embodiment of a clock configured to display time and/or date information in a first format and a second format according to various aspects of the present disclosure.
Figure 7:
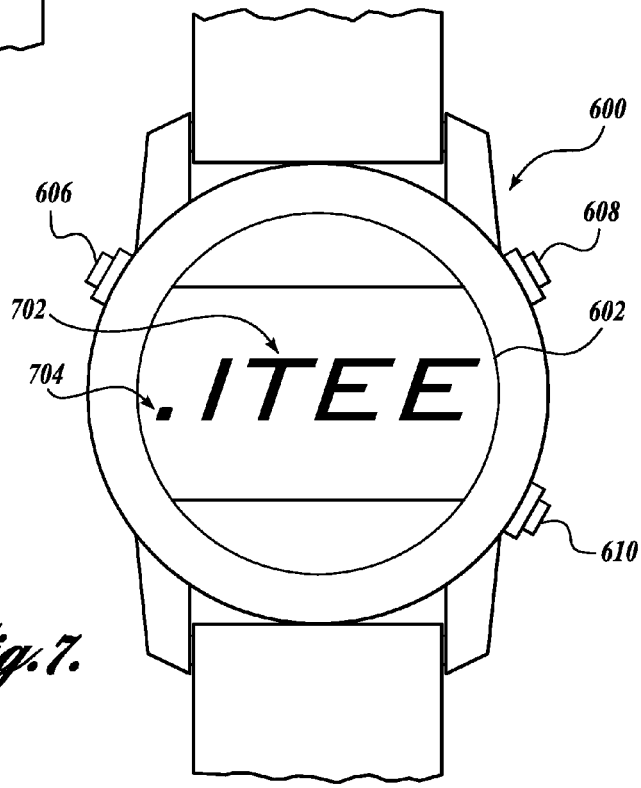

FIGS. 6 and 7 illustrate another exemplary embodiment of a clock 600 configured to display time and/or date information in a first format and a second format according to various aspects of the present disclosure. The illustrated clock 600 may be similar to a common digital wristwatch, though with additional features as described herein.

FIG. 6 illustrates the clock 600 presenting an alphanumeric string 604 representing a time in a first format. The clock 600 includes a display 602, and at least one input device 606, 608, 610. The first format presented by the clock 600 is an hours-minutes format, with a separator between an hours portion and a minutes portion of the time. In other embodiments, the hours-minutes format may also include seconds, tenths of seconds, and/or other components of a traditional time format, and/or may include traditional date information.

FIG. 7 illustrates the clock 600 presenting an alphanumeric string 702 representing the time in a second format. The second format presented by the clock 600 is a CFILORUX format, in which the time is represented by a base-36 number in an alphanumeric string 702. In the illustrated embodiment, the string 702 includes a radix point 704 as the left-most character of the string 702, which indicates that the base-36 number displays a fractional part but not an integral part of the base-36 number. This may indicate that the displayed CFILORUX-format string is a time instead of a date. In other embodiments, the radix point 704 may not be displayed, and the type of information being displayed may be inferred from other context, such as a frequency of updates and/or the like. In still other embodiments, the display 602 may display a date and not a time, in which case the radix point 704 may be the right-most character of the alphanumeric string. In still other embodiments, the radix point 704 may be placed in a different location in a date-time string to ease reading. For example, instead of separating the day portion of the string from the time portion of the string, the radix point may be moved one digit to the right to separate a cycle portion of a time from a fractional cycle portion of the time, to more closely match a traditional time format.

In some embodiments, the display 602 may be switched between the first format and the second format via an interaction with one of the at least one input devices 606, 608, 610. Interaction with one of the at least one input devices 606, 608, 610 may also cause the display 602 to switch between the presentation of date and time information, or a combination of date and time information.

Figure 8:
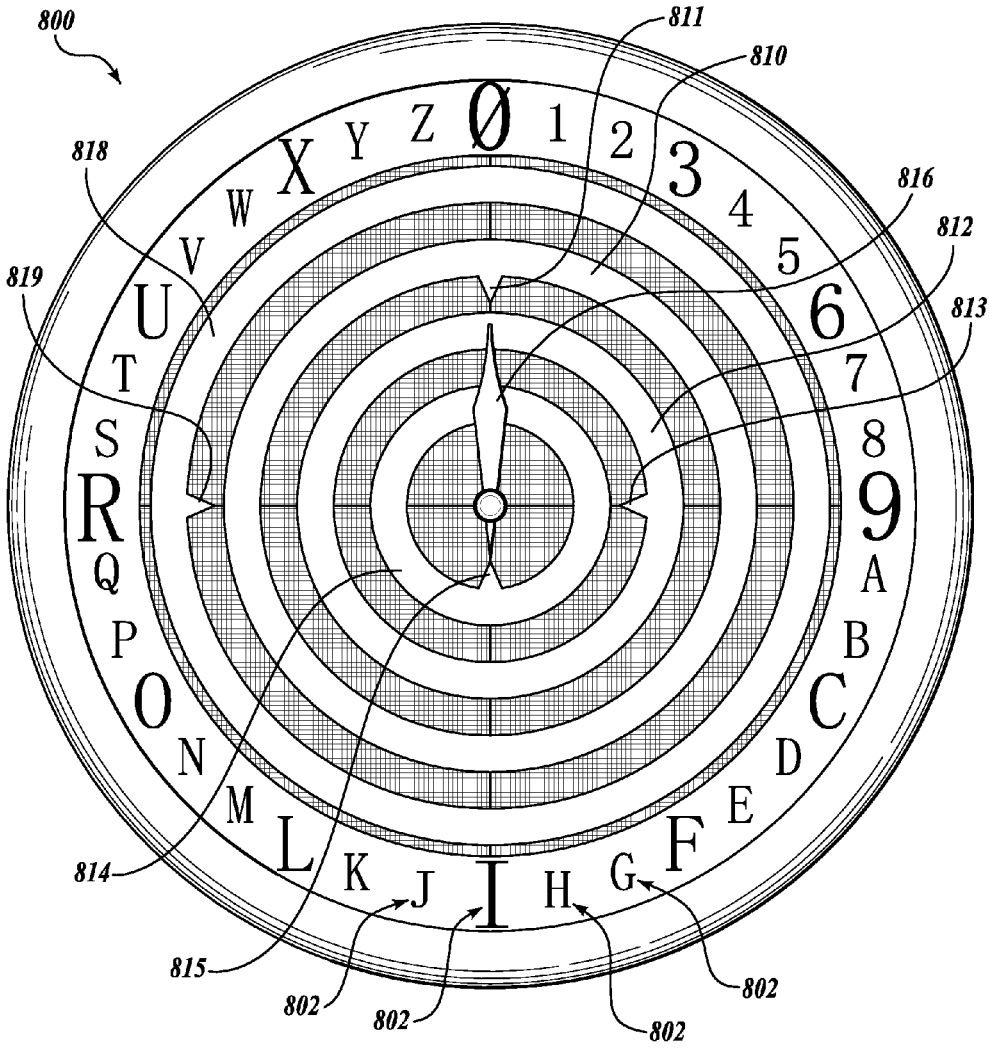
FIG. 8 illustrates an additional exemplary embodiment of a clock according to various aspects of the present disclosure.

FIG. 8 illustrates another exemplary embodiment of a clock 800 according to various aspects of the present disclosure. Similar to the exemplary clock 100 illustrated in FIG. 1, the exemplary clock 800 of FIG. 8 includes a plurality of labels 802 to provide a convenient way for a viewer to note a position of one or more indicators. The illustration of the clock 800 does not include markings such as the plurality of markings 103, 104, 105 illustrated in FIG. 1, but this is for clarity only, and in actual embodiments similar markings may be included on the clock 800. Also, not all of the plurality of labels 802 are pointed out with element numbers in the figure, for clarity.

The clock 800 includes a mechanism (not pictured) that causes a plurality of ring-shaped indicators to rotate. Each ring-shaped indicator includes a ring pointer to indicate an angular position of the associated ring-shaped indicator. As illustrated, the plurality of ring-shaped indicators includes a cycle indicator 818, a day indicator 810, a period indicator 812, and a fraction indicator 814. The ring-shaped indicators include a cycle ring pointer 819, a day ring pointer 811, a period ring pointer 813, and a fraction ring pointer 815. The ring-shaped indicators are illustrated on an exemplary grey hatched background for clarity, but may be any color and used with any background. Also, though the ring pointers are illustrated pointing toward a center of the clock face, the ring pointers may alternatively point out towards the plurality of labels 802, or may take a different form to indicate a position of the ring-shaped indicators.

Similar to the clock 100 of FIG. 1, the ring-shaped indicators of the clock 800 of FIG. 8 rotate at different rates to indicate a date and time. The cycle indicator 818 makes one complete revolution every thirty-six cycles. The day indicator 810 makes one complete revolution every cycle—in other words, every thirty-six days. The period indicator 812 makes one complete revolution every day. The fraction indicator 814 makes one complete revolution every period—in other words, thirty-six revolutions per day. The illustrated clock 800 also optionally includes a (z) second indicator 816, which makes one complete revolution every fraction—in other words, thirty-six revolutions per period, or 1296 revolutions per day. The mechanism may also cause the pointer-shaped (z) second indicator 816 to rotate around the center of the clock 800.

In some embodiments, the mechanism used in the clock 100 or the clock 800 may cause the indicators to travel smoothly over the passage of time. In other embodiments, the mechanism may cause the indicators to move quickly from one label or marking to the next label or marking, then pause until the appropriate time to move to a subsequent label or marking. In still other embodiments, a combination of the two methods may be used. In the embodiment illustrated in FIG. 8, the mechanism causes the indicators to pause at each label for the appropriate amount of time. Hence, to interpret the time shown on the illustrated clock 100, one would note that the cycle indicator 818 is pointing at the label "R," the day indicator 810 is pointing at the label "0," the period indicator 812 is pointing at the label "9," the fraction indicator 814 is pointing at the label "I," and the (z) second indicator 816 is pointing at the label "0." This would indicate a CFILORUX date and time of "R0.9I0". This date is 972 days after the calibrated start date, and indicates a traditional time of 6:20:00 AM.

Figure 9:
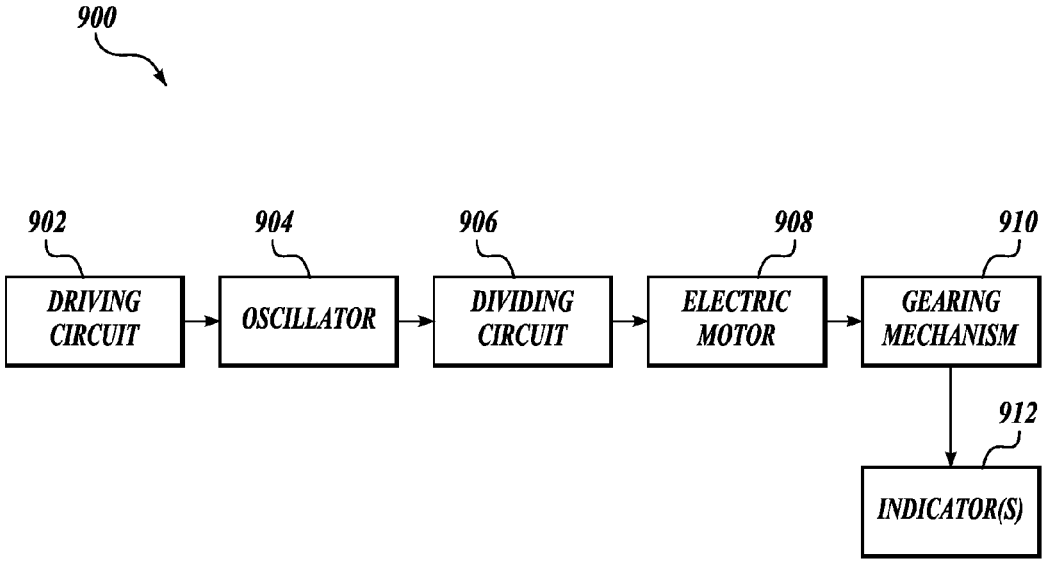
FIG. 9 is a block diagram that illustrates various aspects of an exemplary embodiment of a mechanism suitable for use with analog clocks such as those disclosed herein.

FIG. 9 is a block diagram that illustrates various aspects of an exemplary embodiment of a mechanism 900 suitable for use with analog clocks such as those disclosed herein. A driving circuit 902 provides a driving voltage to an oscillator 904, such as a quartz oscillator and/or the like, that causes the oscillator 904 to vibrate at a constant frequency. The vibration of the oscillator 904 is detected by a dividing circuit 906, which divides the frequency of the oscillator 904 to a frequency suitable for driving an electric motor 908 at a suitable rate. The electric motor 908, in turn, drives a gearing mechanism 910 that is coupled to one or more indicators 912, such as the indicators illustrated and described in FIG. 1 or 8, to indicate the passage of time.

The design and use of each of these components for standard clocks are well known in the art, and so general information concerning the construction of these components has not been included herein. However, traditional components that would drive an hour hand, minute hand, and second hand are reconfigured to provide indicators of the passage of CFILORUX time.

For example, in some embodiments, the gearing mechanism 910 includes an input shaft that is turned at a given speed by the electric motor 908. The input shaft is coupled to a gear that causes a fraction indicator, such as fraction indicator 112, to travel through an angle of 10 degrees for each fraction, such that after 36 fractions have passed, the fraction indicator will have returned to its starting point. The gearing mechanism 910 also includes reduction gears that cause each other indicator to turn faster or slower than the fraction indicator by a factor of thirty-six. For example, the gearing mechanism 910 may include a gear that turns thirty-six times slower than the gear that causes the fraction indicator to travel, such that a period indicator, such as period indicator 110, travels through an angle of 10 degrees for each full revolution of the fraction indicator. Accordingly, after thirty-six revolutions of the fraction indicator, the period indicator will have returned to its starting point. As another example, the gearing mechanism 910 may include a gear that turns thirty-six times faster than the gear that causes the fraction indicator to travel, such that a (z) second indicator, such as (z) second indicator 816, completes a revolution for each angle of 10 degrees traveled by the fraction indicator. In some embodiments, additional indicators that are faster and slower by an arbitrary number of factors of thirty-six may also be included.

In some embodiments of traditional clocks, the oscillator 904 is configured to vibrate at a frequency of 32,768 vibrations per second. The dividing circuit 906 divides the detected frequency by powers of two, to produce output pulses that drive the electric motor 908 at a rate of one pulse per second. In some embodiments of the present disclosure, the gearing mechanism 910 may include a transformation gear that reduces the output speed of the traditional electric motor 908 calibrated to drive an input shaft coupled via gears to a traditional second hand to a speed suitable to drive the input shaft coupled via gears to the fraction indicator as described above. For example, since each fraction is $^{50}/_{27}$ths of a traditional second long, the transformation gear may reduce the output speed of the electric motor 908 to $^{27}/_{50}$ths of its original speed.

In some embodiments of the present disclosure, a specially configured oscillator 904 may be used. For example, in some embodiments, an oscillator 904 may be configured to oscillate 21600 times per traditional second. Such an oscillator 904 would therefore oscillate 40000 times per fraction. In such an embodiment, the dividing circuit 906 is configured to divide the signal from the oscillator 904 to provide one pulse to the electric motor 908 every 40000 oscillations. Each pulse would then cause the electric motor 908 to turn the input shaft an amount that causes the portion of the gearing mechanism 910 coupled to the fraction indicator to travel through an angle of 10 degrees.

While illustrative embodiments have been illustrated and described, it will be appreciated that various changes can be made therein without departing from the spirit and scope of the invention. As one example, the terms "CFILORUX," "cycle," "period," "fraction," "(z) second," and so on are used merely for ease of discussion and are exemplary only. Other terms may be used for similar concepts without departing from the scope of the present disclosure. As another example, oscillators that provide vibrations at different speeds than those disclosed herein may be used. One of ordinary skill in the art would recognize that appropriate gearing mechanisms and/or dividing circuits may be used with such oscillators to provide the functionality described herein without departing from the scope of the present disclosure. As yet another example, in some embodiments the radix point may not separate the date from the time, and instead may be placed at a different position to ease interpretation. For instance, as described above with respect to FIG. 7, the string ".ITEE" may reflect a time that is "I" periods after the beginning of the day. In other embodiments, a string such as "I.TEE" may carry a similar meaning. Further, the described devices may contain additional functionality or components not described herein without departing from the scope of the present disclosure.

The embodiments of the invention in which an exclusive property or privilege is claimed are defined as follows:

1. A device for displaying time information, comprising:

a mechanism configured to generate an indication of passing time;

a processor configured to interpret the generated indication of passing time received from the mechanism;

at least one input device communicatively coupled to the processor; and a display communicatively coupled to the processor and configured to present an alphanumeric string representing a time;

wherein the processor is configured to:

cause the display to present an alphanumeric string representing the film in a first format or a second format; and cause the display to switch between the first format and the second format in response to an interaction with the at least one input device;

wherein the first format includes a time of day in an hours-minutes format; and wherein the second format includes a tune that has passed since a beginning of as day in base-36 format.

2. The device as recited in claim 1, wherein the first format includes as date in a traditional calendar format, and wherein the second formal includes a number of days that have passed since a specified point in time in base-36 format.

3. The device as recited in claim 2 wherein the time that has passed since the beginning of the day of the second format and the number of days that have passed since the specified point in time of the second format are displayed as a single base-36 number having the number of days as an integral part of the number and the time that has passed since the beginning of the day as a fractional part of the number.

4. The device as recited in claim 3, wherein the processor is configured to change the specified point in time in response to receiving an input via the at least one input device.

5. The device as recited in claim 4, wherein the specified point in time is before a time when the input is received.

6. The device as recited in claim 3, wherein the processor is configured to change a count of significant digits of the fractional part of the number that are displayed in response to receiving an input via the at least one input device.

7. A clock configured to display a time of day, wherein the time of day is displayed as a base-36 number representing a fractional period of a day that has passed since the previous day, wherein the clock is further configured to display an equivalent time in a traditional hours-minutes format in response to a request by a user.

8. The clock as recited in claim 7, wherein the clock is further configured to display a date, wherein the date is displayed as an integral portion of the base-36 number representing a number of days that have passed since a start day.

9. The clock as recited in claim 8, wherein the start day is configurable by a user of the clock.

10. The clock as recited in claim 8, wherein the clock is configured to display an equivalent date in a traditional calendar format in respond to a request by a user.

11. The clock as recited in claim 7, wherein the clock is configured to:

accept base-36 number as input from a user as an alphanumeric string;

convert base-36 number to an equivalent time in 12-hour format or 24-hour format; and present the equivalent time the user.

12. The clock as recited in claim 11 wherein the alphanumeric string includes a radix point, and wherein the clock is further configured to:

convert the base-36 number to an equivalent date on a traditional calendar and an equivalent time in 12-hour format or 24-hour format; and present the equivalent date and time to the user.

13. A clock configured to display a time of day, wherein the time of day is displayed as a base-36 number representing a fractional period of a day that has passed since the previous day:

wherein the clock is further configured to display a date as at integral portion of the base-36 number representing a number of days that have passed since a start day; and wherein the clock is configured to display an equivalent date in a traditional calendar format in response to a request by a user.

14. The clock as recited in claim 13, wherein the clock is configured to display an equivalent time in a traditional hours-minutes format in response to a request by a user.

15. The clock as recited in claim 13, wherein the start day is configurable by a user of the clock.

16. The clock as recited in claim 13, wherein the clock is configured to:

accept a base-36 number as input from a user as an alphanumeric string;

convert the base-36 number to an equivalent time in 12-hour format or 24-hour format; and present the equivalent time the user.

17. The clock as recited in claim 16, wherein the alphanumeric string includes a radix point, and wherein the clock is further configured to:

convert the base-36 number to an equivalent date on a traditional calendar and an equivalent time in 12-hour tot mat or 24-hour format; and present the equivalent date and time to the user.

* * * * *

UNITED STATES PATENT AND TRADEMARK OFFICE

CERTIFICATE OF CORRECTION

PATENT NO. : 8,379,489 B1
APPLICATION NO. : 13/484198
DATED : February 19, 2013
INVENTOR(S) : John David Jones It is certified that error appears in the above-identified patent and that said Letters Patent is hereby corrected as shown below:

Title Page, Item (56), Other Publications, line 11: "ArchiveShodorl;" to read as --ArchiveShodor1;--.

In the Specifications:

Column 6, line 2, "regional" to read as --regnal--.

In the Claims:

Column 10, line 16, claim 1: "film" to read as --time--.

Column 10, line 23, claim 1: "tune" to read as --time--.

Column 10, line 24, claim 1: "as" to read as --a--.

Column 10, line 26, claim 2: "as" to read as --a--.

Column 10, line 27, claim 2: "formal" to read as --format--.

Column 10, line 29, claim 3: "claim 2" to read as --claim 2,--.

Column 10, line 60, claim 10: "respond" to read as --response--.

Column 10, line 63, claim 11: "accept base" to read as --accept a base--.

Column 10, line 65, claim 11: "convert base" to read as --convert the base--.

Column 10, line 67, claim 11: "time the" to read as --time to the--.

Column 11, line 1, claim 12: "claim 11" to read as --claim 11,--.

Column 11, line 12, claim 13: "at" to read as --an--.

Signed and Sealed this
Fourteenth Day of May, 2013

Teresa Stanek Rea
*Acting Director of the United States Patent and Trademark Office*

Column 12, line 9, claim 16: “time the” to read as --time to the--.

Column 12, line 14-15, claim 17: “tot mat” to read as --format--.